United States Patent [19]

Cherian

[11] Patent Number: 4,731,638

[45] Date of Patent: Mar. 15, 1988

[54] TIMING PULSE GENERATOR FOR AN ELECTROPHOTOGRAPHIC PRINTING MACHINE

[75] Inventor: Abraham Cherian, Webster, N.Y.

[73] Assignee: Xerox Corporation, Stamford, Conn.

[21] Appl. No.: 935,373

[22] Filed: Nov. 26, 1986

[51] Int. Cl.[4] ..... G03G 15/00

[52] U.S. Cl. ..... 355/14 R; 355/3 DR

[58] Field of Search ..... 355/3 DR, 3 R, 14 R; 354/15

[56] References Cited

U.S. PATENT DOCUMENTS

| | | | |
|---|---|---|---|
| 2,950,662 | 8/1960 | Higonnet et al. | 95/4.5 |
| 3,974,379 | 8/1976 | Hamann et al. | 250/233 |
| 4,196,986 | 4/1980 | Moyroud | 355/1 |
| 4,400,069 | 8/1983 | St. Pierre et al. | 354/15 |
| 4,400,443 | 8/1983 | Green | 428/571 |
| 4,547,062 | 10/1985 | Fujiwara | 355/14 R |

FOREIGN PATENT DOCUMENTS

| | | |
|---|---|---|
| 55-144256 | 11/1980 | Japan . |
| 58-127942 | 7/1983 | Japan . |

*Primary Examiner*—Patrick R. Salce
*Assistant Examiner*—Judson H. Jones
*Attorney, Agent, or Firm*—H. Fleischer; J. E. Beck; R. Zibelli

[57] ABSTRACT

An apparatus which generates timing pulses in an electrophotographic printing machine. A flexible member having spaced, marks formed photographically thereon is mounted on the shaft of the photoconductive member to rotate in unison therewith. As the flexible member rotates, the spaced marks are detected to generate a timing pulse output in response thereto. The detector prevents the member from deflecting to control the axial motion of the flexible member during the rotation thereof.

16 Claims, 5 Drawing Figures

TIMING PULSE GENERATOR FOR AN ELECTROPHOTOGRAPHIC PRINTING MACHINE

This invention relates generally to an electrophotographic printing machine, and more particularly concerns an apparatus for generating timing pulses therein.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained in the original document. After the electrostatic latent image is recorded on the photoconductive member, the latent image is developed by bringing a developer material into contact therewith. This forms a powder image on the photoconductive member which is subsequently transferred to a copy sheet. Finally, the powder image is heated to permanently fuse it to the copy sheet in image configuration.

In an electrophotographic printing machine, a plurality of processing stations are positioned about the photoconductive member. Furthermore, other processing stations are located in the path of the copy sheet. These processing stations perform all of the operations necessary to insure that a completed copy of an original document is generated. Each processing station is energized at a selected time during the operating cycle. This is achieved by a timing pulse generator associated with the photoconductive member. Generally, the timing pulse generator is a disk having a plurality of spaced marks thereon arranged to rotate with the photoconductive drum. Each mark is an event signal for timing the operations in the printing machine. Generally, the disk is made from glass with the markings etched thereon or formed as slits therein. A light source and a light detector are disposed on either side of the disk to sense the passage of the marks or slits. In this way, a pulse is generated for each increment between adjacent marks or slits on the timing disk. These pulses are transmitted to the control system which actuates the appropriate processing station at the requisite time to insure the formation of the copy of the original document on the sheet of support material.

Various approaches have been devised for generating timing pulses. The following disclosures appear to be relevant:

U.S. Pat. No. 2,950,662,
Patentee: Higonnet et al.,
Issued: Aug. 30, 1960;
U.S. Pat. No. 3,974,379,
Patentee: Hamann et al.,
Issued: Aug. 10, 1976;
U.S. Pat. No. 4,400,443,
Patentee:: Green,
Issued: Aug. 23, 1983;
U.S. Pat. No. 4,547,062,
Patentee: Fujiwara,
Issued: Oct. 15, 1985;
Japanese Appln. No. 55-144256,
Applicant: Hashimoto
Published: Nov. 11, 1980;
Japanese Patent Appln. No. 58-127942,
Applicant: Ikeda, Published: July 30, 1983.

The relevant portions of the foregoing disclosures may be briefly summarized as follows:

Higonnet et al. discloses a photocomposing machine which utilizes a disk that is developed photographically. Pulses are generated by developed characters on the disk.

Hamann et al. describes a plastic disk reinforced by metal disks. The plastic disk is used with a disk segment to generate pulses and comprises a film that is exposed to line patterns.

Green discloses a durable, perforated encoder disk comprising two layers of materials laminated together. Large perforations in a thicker layer and small perforations in a thinner layer are combined to provide a durable disk with accurately sized openings.

Fujiwara describes a timing control device employing a slit plate rotating in unison with a photoconductive drum. Pulses generated from the slit plate are used in conjunction with a paper supply timing roller. This provides a means to accurately control the paper supply timing regardless of variations in the machine components.

Hashimoto discloses a potential measuring device for a photoreceptor. The device consists of a perforated plate and sensor parallel to the photoreceptor.

Ikeda describes a device whereby sequential control timing is corrected by pulses generated by a disk rotating with a photoconductive drum.

In accordance with one aspect of the present invention, there is provided an apparatus for generating timing pulses in an electrophotographic printing machine. The apparatus includes a flexible, member having spaced marks formed photographically thereon. Means support the member rotatably in the printing machine. Means are provided for detecting the spaced marks on the member and generating a timing pulse output in response thereto. The detecting means prevents the member from deflecting to control the axial motion of the member during rotation.

Pursuant to another aspect of the present invention, there is provided an electrophotographic printing machine of the type having a moving photoconductive member. The printing machine includes a plurality of processing stations arranged to reproduce copies of an original document. A flexible member has spaced marks formed photographically thereon. Means support the member on the photoconductive member to move in unison therewith. Means detect the spaced marks on the member and generate a timing pulse output in response thereto to control the energization and de-energization of the processing stations. The detecting means prevents the member from deflecting to control the axial motion of the member during the movement thereof.

Other features of the present invention will become apparent as the following description proceeds and upon reference to the drawings, in which.

Figure 2:
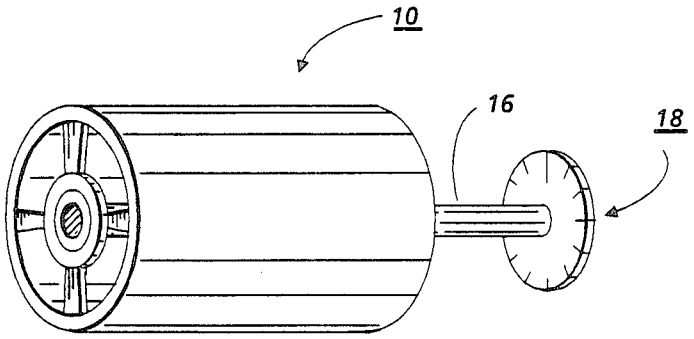
FIG. 2 is a schematic perspective view showing the timing disk of the present invention used in the FIG. 1 printing machine.
Figure 4A:
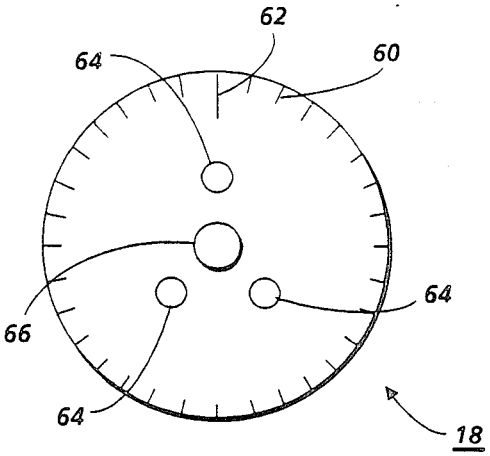

FIG. 4*a* is an elevational view showing the FIG. 2 timing disk; and

Figure 4B:
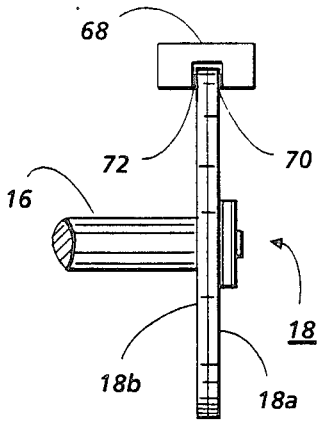

FIG. 4*b* is a schematic, side elevational view of the timing disk and sensing system associated therewith.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
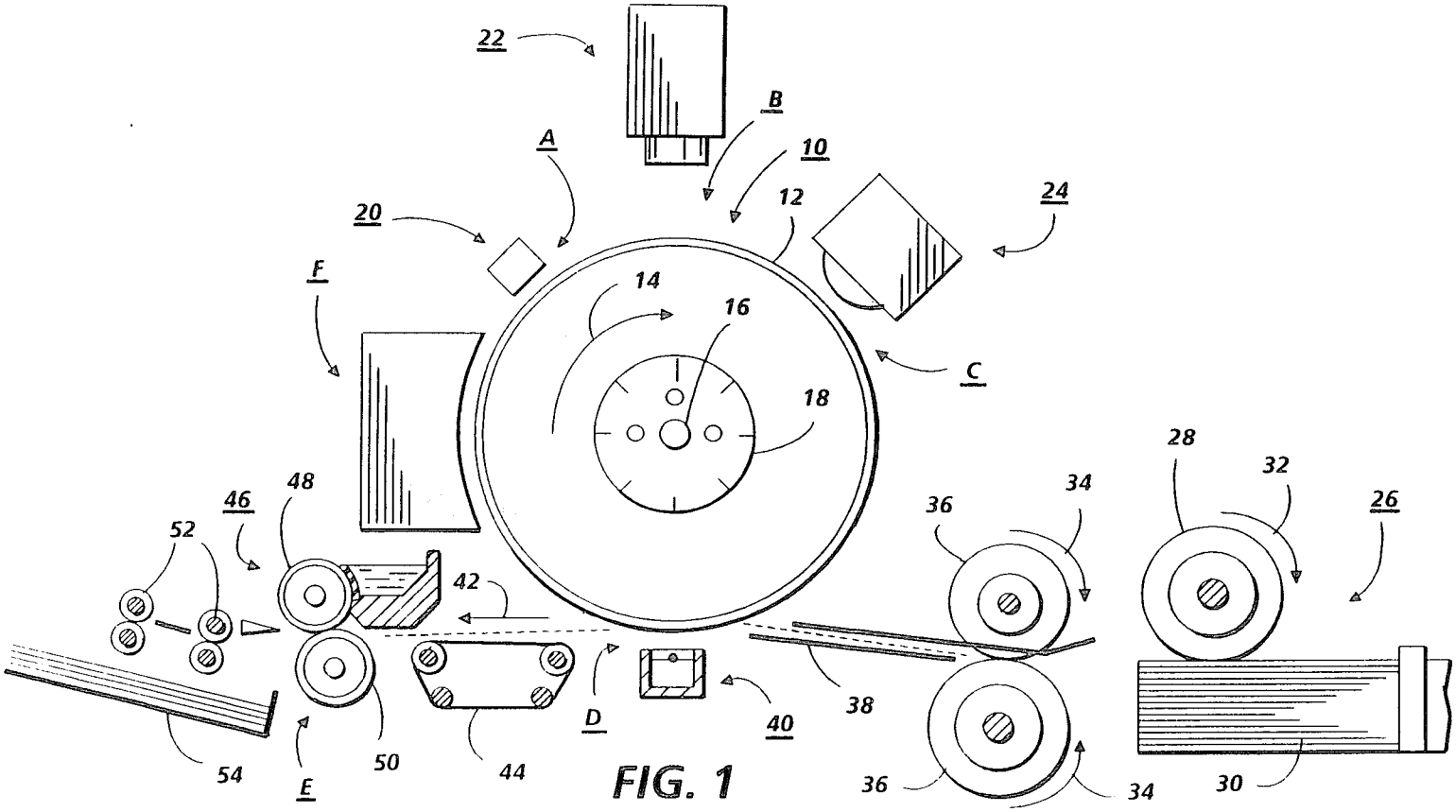
FIG. 1 is a schematic elevational view of an illustrative electrophotographic printing machine incorporating the features of the present invention therein.

As shown in FIG. 1, the illustrative electrophotographic printing machine employs a drum 10 having a photoconductive surface 12. By way of example, photoconductive surface 12 is made from a selenium alloy adhering to an electrically grounded conductive substrate, made from aluminum. Drum 10 moves in the direction of arrow 14 to advance photoconductive surface 12 sequentially through the various processing stations disposed about the path of movement thereof. Drum 10 is mounted on shaft 16 which extends outwardly therefrom. Timing disk 18 is mounted on shaft 16. Timing disk 18 includes a plurality of substantially equally spaced marks thereon. As timing disk 18 rotates in the direction of arrow 14 in unison with drum 10, the marks pass through a path of light emitted from a light source. Inasmuch as the marks or lines on disk 18 are substantially opaque with the remainder of the disk being substantially transparent, the light rays are transmitted through the disk at all positions other than at the lines or marks so as to be detected by a photodetector. When the lines are in the light path, the photodetector senses the blockage of the light. In response to the light blockage, or failure to detect light rays, the photodetector emits a pulse for each line passing between the photodetector and light source. These pulses act as event or timing pulses for energizing and de-energizing the various processing station in the electrophotographic printing machine. With continued reference to FIG. 1, the various processing stations in the electrophotographic printing machine will be described. FIGS. 2 through 4*b*, inclusive, describe the details of the timing disk and the manner in which the electrical pulses are generated.

With continued reference to FIG. 1, initially, a portion of photoconductive surface 12 passes through charging station A. At charging station A, a corona generating device, indicated generally by the reference numeral 20 charges photoconductive surface 12 to a relatively high, substantially uniform potential.

Next, the charged portion of photoconductive surface 12 is advanced through exposure station B. Exposure station B includes an exposure system indicated generally by the reference numeral 22. Exposure system 22 includes a light source which illuminates an original document positioned face down upon a transparent platen. Light rays reflected from the original document are transmitted through a lens to form a light image thereof. The light image is focused onto the charged portion of photoconductive surface 12 to selectively dissipate the charge thereon. This records an electrostatic latent image on photoconductive surface 12 which corresponds to the informational areas contained within the original document. One skilled in the art will appreciate that in lieu of the foregoing optical system, a modulated beam of energy, i.e. a laser beam, or other suitable devise, such as light emitting diodes may be used to irradiate the charged portion of the photoconductive surface so as to record selected information thereon. Information from a computer may be employed to modulate the laser beam or selectively energize the light emitting diodes.

After the electrostatic latent image is recorded on photoconductive surface 12, drum 10 advances the latent image to development station C. At development station C, a magnetic brush development system, indicated generally by the reference numeral 24, advances a developer material comprising at least carrier granules and toner particles into contact with the electrostatic latent image. The latent image attracts the toner particles from the carrier granules of the developer material to form a toner powder image on photoconductive surface 12 of drum 10.

Drum 10 then advances the toner powder image image adhering to photoconductive surface 12 to transfer station D. At transfer station D, a sheet of support material is moved into contact with the powder image. The sheet of support material is advanced to transfer station D by a sheet feeding apparatus, indicated generally by the reference numeral 26. Preferably, sheet feeding apparatus 26 includes a feed roll 28 contacting the uppermost sheet of a stack of sheets 30. Feed roll 28 rotates in the direction of arrow 32 to advance the uppermost sheet into the nip defined by forwarding rollers 32. Forwarding rollers 32 rotate in the direction of arrow 34 to advance the sheet into chute 38. Chute 38 directs the advancing sheet of support material into contact with photoconductive surface 12 of drum 10 in a timed sequence so that the toner powder image developed thereon contacts the advancing sheet at transfer station D. Preferably, transfer station D includes a corona generating device 40 for spraying ions onto the backside of the sheet. This attracts the toner powder image from photoconductive surface 12 to the sheet. After transfer, the sheet continues to move in the direction of arrow 42 onto conveyor 44 which advances the sheet to fusing station E.

Fusing station E includes a fuser assembly, indicated generally by the reference numeral 46, which permanently fuses the transferred toner powder image to the sheet. Fuser assembly 46 includes a heated fuser roller 48 and back-up roller 50. The sheet passes between fuser roller 48 and back-up roller 50 with the toner powder image contacting fuser roller 48. In this manner, the toner powder image is permanently fused to the sheet. After fusing, forwarding rollers 62 advance the sheet to catch tray 54 for removal from the printing machine by the operator.

Invariably, after the sheet of support material is separated from photoconductive surface 12 of drum 10, some residual particles remain adhering thereto. These residual particles are removed from photoconductive surface 12 at cleaning station F. Preferably, cleaning station F includes a rotatably mounted brush in contact with photoconductive surface 12. The particles are cleaned from photoconductive surface 12 by the rotation of the brush in contact therewith. Subsequent to cleaning, a discharge lamp floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Referring now to FIG. 2, the arrangement of disk 18 to generate timing signals for synchronizing the occurrence of the various machine processes and events with the rotation of drum 10 is shown. these signals are generated through the use of disk 18 secured to shaft 16 extending from drum 10 and aligned therewith. A plurality of lines are formed on the disk. Each line is opaque with the remainder of the disk being substantially transparent. The plurality of lines are formed on the disk photographically. Each line has a predetermined angular orientation with respect to a reference line, the reference line being oriented with respect to a predetermined position of drum 10.

Figure 3:
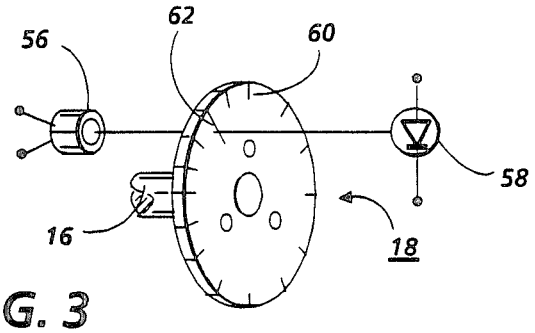
FIG. 3 is a schematic perspective view illustrating a signal generating arrangement employed with the timing disk of FIG. 2.

Turning now to FIG. 3, a light emitting diode 56 is positioned on one side of disk 18 with photosensor 58 being positioned on the opposite side of disk 18. Light emitting diode 56 is arranged to project light rays onto disk 18 in the region of lines 60. Photosensor 58 is positioned to receive the light rays transmitted through disk 18 with pulses being generated when the lines block the light rays. In this way, a series of electrical pulses are thus generated as drum 10 rotates. The occurrence and time of these pulses is related to the angular position of drum 10 with respect to reference line 62. These pulses comprise the event clock signal. A similar light emitting diode and photosensor (not shown) are also provided in position on opposite sides of disk 18 near reference line 62 for generating a single signal termed a pitch signal for each complete revolution of drum 10. The number of lines on disk 18 defines the number of events that occur with respect to predetermined rotational positions of drum 10. This number can vary in accordance with the specifics of the printing machine and its requirements. Each line is oriented on disk 18 to provide an output signal to initiate an event. The lines need not be equally spaced from one another.

Referring now to FIGS. 4*a*, there is shown an elevational view of disk 18. As shown thereat, disk 18 includes a plurality of lines 60 spaced from one another with a reference line 62 disposed thereon as well. Lines 60 and 62 are opaque with the remainder of disk 18 being substantially transparent. Disk 18 is made from a flexible plastic photographic film. By way of example, disk 18 can be made from Mylar, a trademark of the DuPont Corporation. Lines 60 and 62 are precisely located with respect to locating holes 64 and mounting hole 66. In manufacturing disk 18, a blank disk has locating holes 64 and mounting hole 66 formed therein. These holes are then used to mount the blank disk in a fixture. At this time, lines 60 and 62 are photographically formed on the blank disk. After the lines have been formed, these same holes 64 and 66 are used to mount disk 18 onto shaft 16 extending from drum 10. This insures the precise alignment of lines 60 and 62 with respect to drum 10.

Turning now to FIG. 4*b*, disk 18 is made from two plastic films, 18*a* and 18*b*. Both films are mounted on shaft 16 extending from drum 10. Film 18*a* has lines 60 and 62 formed thereon while film 18*b* is substantially transparent with no lines formed thereon. Film 18*b* is a protective film to prevent inadvertent damage to film 18*a*. Both film 18*a* and film 18*b* are made from Mylar. By way of example, film 18*a* is about 0.006 inches thick. In an exemplary electrophotographic printing machine, there can be as many as 300 lines formed photographically on film 18*a* so as to generate 300 pulses or events. Light emitting diode 56 and photosensor 58 are mounted in assembly 68. Sensor assembly 68 is also precisely mounted with respect locating hole 64 and mounting hole 66. Lines 60 and 62 (FIG. 4*a*) extend about the circumferential portion of disk 18 on film 18*a*. Sensor assembly 68 has end regions 70 and 72 extending beyond the circumferential region to engage one side of the film 18*a* and one side of film 18*b*. End region 70 engages film 18*a* beyond the circumferential region thereof so as to be spaced from lines 60 and 62. End region 72 engages film 18*b*. In this way, sensor assembly 68 prevents deflection of disk 18, in the axial direction as disk 18 rotates with drum 10. This insures that there is a minimum amount of axial motion so as to maintain the necessary accuracy. Thus, sensor assembly 68 captures films 18*a* and 18*b* of disk 18 to prevent deflection thereof so as to control axial motion during the rotation thereof with drum 10.

In an electrophotographic printing machine, occasionally dirt particles or residual toner particles may contaminate the timing apparatus. To prevent the foregoing from occurring, a wiper assembly may be associated with disk 18 as as to remove any particles adhering thereto. A system of this type has undergone extensive testing and appears to have a life well in access of a typical electrophotographic printing machine. Furthermore, a timing disk of this type appears to be significantly less expensive than those heretofore employed.

In recapitulation, it is clear that the timing disk of the present invention is formed from at least one layer of a think plastic film which has spaced lines formed about the circumference thereof photographically. An additional film is positioned adjacent one side thereof to provide protection therefor. A sensor assembly detects these lines and generates a pulse corresponding thereto. The sensor assembly also prevents axial deflection during the rotation of the disk so as to preserve the requisite accuracy thereof.

It is, therefore, evident that there has been provided in accordance with the present invention, an apparatus for generating timing pulses in an electrophotographic printing machine that fully satisfies the aims and advantages hereinbefore set forth. While this invention has been described in conjunction with a preferred embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for generating timing pulses in an electrophotographic printing machine, including:

a flexible member having spaced marks formed photographically thereon;

means for mounting said member rotatably in the printing machine; and means for detecting the spaced marks on said member and generating a timing pulse output in response thereto, said detecting means preventing said member from deflecting to control the axial motion of said member during rotation.

2. An apparatus according to claim 1, further including a protective member positioned to have one side thereof adjacent one side of said member.

3. An apparatus according to claim 2, wherein said detecting means is adapted to engage the other side of said protective member and the other side of said member.

4. An apparatus according to claim 3, wherein said flexible member is a disk made from a substantially transparent plastic film.

5. An apparatus according to claim 4, wherein the spaced marks on said disk are spaced, substantially opaque lines located about the circumference thereof.

6. An apparatus according to claim 5, wherein said detecting means is spaced from the lines of said disk.

7. An apparatus according to claim 6, wherein said detecting means includes:

a light source positioned to direct light rays through said disk in the path of the lines in the circumference thereof; and a photodetector positioned to receive the light rays passing through said disk to produce timing pulses in response to the blockage of the light rays by the lines thereon.

8. An apparatus according to claim 7, wherein said protective member includes a transparent, flexible disk made from a plastic film.

9. An electrophotographic printing machine of the type having a moving photoconductive member, including:

a plurality of processing stations arranged to reproduce copies of an original document;

a flexible member having spaced marks formed photographically thereon;

means for mounting said member on the photoconductive member to move in unison therewith; and means for detecting the spaced marks on said member and generating a timing pulse output in response thereto to control the energization and de-energization of said plurality of processing stations, said detecting means preventing said member from deflecting to control the axial motion of said member during the movement thereof.

10. A printing machine according to claim 9, further including a protective member positioned to have one side thereof adjacent one side of said member.

11. A printing machine according to claim 10, wherein said detecting means is adapted to engage the other side of said protective member and the other side of said member.

12. A printing machine according to claim 11, wherein said flexible member is a disk made from a substantially transparent plastic film.

13. A printing machine according to claim 12, wherein the spaced marks on said disk are spaced, substantially opaque lines located about the circumference thereof.

14. A printing machine according to claim 13, wherein said detecting means is positioned to be spaced from the lines on said disk.

15. A printing machine according to claim 14, wherein said detecting means includes:

a light source positioned to direct light rays through said disk in the path of the lines in the circumference thereof; and a photodetector positioned to receive the light rays passing through said disk to produce timing pulses in response to the blockage of light rays by the lines thereon.

16. A printing machine according to claim 15, wherein said protective member includes a transparent, flexible disk made from a plastic film.

* * * * *